US012371948B2

(12) United States Patent
Zhang et al.

(10) Patent No.: US 12,371,948 B2
(45) Date of Patent: Jul. 29, 2025

(54) WIRE-GUIDED AUTOMATIC PAY-OFF DEVICE AND METHOD

(71) Applicant: XCMG FOUNDATION CONSTRUCTION MACHINERY CO., LTD., Jiangsu (CN)

(72) Inventors: Zhonghai Zhang, Jiangsu (CN); Ming Li, Jiangsu (CN); Genying Li, Jiangsu (CN); Ming Yang, Jiangsu (CN); Xiang Wang, Jiangsu (CN); Zhen Han, Jiangsu (CN); Mengci Zhang, Jiangsu (CN); Chengming Shan, Jiangsu (CN); Xiaobo Niu, Jiangsu (CN); Shuai Wang, Jiangsu (CN); Wendeng Li, Jiangsu (CN); Zuoshuai Sun, Jiangsu (CN)

(73) Assignee: XCMG FOUNDATION CONSTRUCTION MACHINERY CO., LTD., Jiangsu (CN)

( * ) Notice: Subject to any disclaimer, the term of this patent is extended or adjusted under 35 U.S.C. 154(b) by 0 days.

(21) Appl. No.: 18/713,189

(22) PCT Filed: Jul. 8, 2022

(86) PCT No.: PCT/CN2022/104540
§ 371 (c)(1),
(2) Date: May 24, 2024

(87) PCT Pub. No.: WO2023/093069
PCT Pub. Date: Jun. 1, 2023

(65) Prior Publication Data

US 2024/0351820 A1 Oct. 24, 2024

(30) Foreign Application Priority Data

Nov. 25, 2021 (CN) ..... 202111411456.3

(51) Int. Cl.
*E21B 7/04* (2006.01)
*B65H 49/06* (2006.01)
(Continued)

(52) U.S. Cl.
CPC ..... *E21B 7/046* (2013.01); *B65H 49/06* (2013.01); *B65H 57/26* (2013.01); *E21B 17/028* (2013.01); *E21B 47/12* (2013.01)

(58) Field of Classification Search
CPC ..... E21B 7/046; E21B 17/028; E21B 47/12; E21B 17/026; B65H 57/26; B65H 49/06;
(Continued)

(56) References Cited

U.S. PATENT DOCUMENTS 2,370,818 A 3/1945 Silverman
3,007,534 A 11/1961 Salnikov et al.
(Continued)

FOREIGN PATENT DOCUMENTS

CN 101545374 9/2009
CN 107130958 9/2017
(Continued)

OTHER PUBLICATIONS

"International Search Report (Form PCT/ISA/210) of PCT/CN2022/104540", mailed on Oct. 9, 2022, with English translation thereof, pp. 1-6.

*Primary Examiner* — Brad Harcourt
(74) *Attorney, Agent, or Firm* — JCIPRNET

(57) ABSTRACT

Disclosed are a wire-guided automatic pay-off device and method. The wire-guided automatic pay-off device is installed on a horizontal directional drilling rig and comprises a conductive ring assembly, a brush assembly, a winding device, a guide device and a guide wire. The conductive ring assembly fixed to a main shaft of a carriage assembly rotates together with the main shaft, the brush
(Continued)

assembly fixed to a body of the carriage assembly does not rotate with the main shaft, and a conductive end of the brush assembly is in contact with the conductive ring assembly. The guide wire wound on the winding device has one end connected to the conductive ring assembly and the other end passing through the guide device, penetrating into a central hole in a drill pipe from a rear end of the drill pipe.

6 Claims, 8 Drawing Sheets

(51) Int. Cl.

| | |
|---|---|
| ***B65H 57/26*** | (2006.01) |
| ***E21B 17/02*** | (2006.01) |
| ***E21B 47/12*** | (2012.01) |

(58) Field of Classification Search
CPC .... B65H 57/14; B65H 2701/34; B65H 49/18; B65H 59/06
See application file for complete search history.

(56) References Cited

U.S. PATENT DOCUMENTS

| | | | | |
|---|---|---|---|---|
| 4,295,536 | A * | 10/1981 | Jones, Jr. | E21B 33/072 285/373 |
| 4,399,877 | A * | 8/1983 | Jackson | E21B 23/14 175/320 |
| 5,813,482 | A * | 9/1998 | Barbera | E21D 9/108 175/73 |
| 6,105,692 | A | 8/2000 | Clarke et al. | |
| 2010/0194588 | A1 * | 8/2010 | Menezes | G01V 1/22 340/854.9 |
| 2020/0263509 | A1 | 8/2020 | Boike et al. | |

FOREIGN PATENT DOCUMENTS

| | | |
|---|---|---|
| CN | 112459720 | 3/2021 |
| CN | 113006783 | 6/2021 |
| CN | 113830611 | 12/2021 |
| DE | 20202395 | 6/2002 |
| EP | 3828375 | 6/2021 |
| SU | 1218055 | 3/1986 |

* cited by examiner

WIRE-GUIDED AUTOMATIC PAY-OFF DEVICE AND METHOD

CROSS-REFERENCE TO RELATED APPLICATION

This application is a 371 of international application of PCT application serial no. PCT/CN2022/104540, filed on Jul. 8, 2022, which claims the priority benefit of China application no. 202111411456.3, filed on Nov. 25, 2021. The entirety of each of the above-mentioned patent applications is hereby incorporated by reference herein and made a part of this specification.

TECHNICAL FIELD

The invention relates to the technical field of horizontal directional drilling rigs, and particularly relates to a wire-guided automatic pay-off device and method.

DESCRIPTION OF RELATED ART

The construction process of trenchless horizontal directional drilling rigs usually includes a process of drilling a pilot hole, a process of expanding the hole and a process of pulling back pipes. The process of drilling the pilot hole is a crucial stage that has a direct bearing on whether pipes can be laid along a specified trajectory. So, the key technology of trenchless pipelaying is accurate control of the trajectory of the pilot hole to ensure that pipes can keep away from original underground lines and obstacles and can be laid accurately and smoothly as designed. Control of the trajectory of the pilot hole relies on a probe, which is arranged in a guide bit and transmits signals to a console display by means of a signal transmission device, and an operator operates a drilling rig according to a planned trajectory to guarantee accurate control of the trajectory of the pilot hole. According to the signal transmission manner, wire guiding or wireless guiding can be adopted. Under an ideal geological condition without signal interference, the guiding task can be fulfilled by means of a wireless guiding system. However, under a complex geological condition, guiding and positioning may be inaccurate due to signal interference, leading to a failure to carry out drilling according to a designed trajectory. In a case of wire guiding, a guide wire is connected to the probe in the drill bit to transmit signals, such that the signals are more stable and reliable. During the wire-guided construction process, the guide wire needs to penetrate into a central hole of a drill pipe: after pushing one drill pipe in, a carriage needs to return to load a new drill pipe; and every time a drill pipe is added, rewiring is required. At present, a wire, the length of which has been measured, is manually paid off from a construction device and then penetrates into the central hole of a drill pipe from one end of the drill pipe. As a result, the guide wire is more likely to tangle up, and at both ends of the drill pipe need to be operated by operators. In addition, the wire in the central hole of the drill pipe driven into mud cannot be automatically tensioned and is likely to break at a joint due to impact and stirring of mud flowing back into the central hole, leading to a failure to drill a pilot hole, and the drill pipe needs to be pulled back to perform re-drilling, resulting in high construction risk, high labor cost and low the pay-off efficiency.

BRIEF SUMMARY OF THE INVENTION

The objective of the invention is to provide a wire-guided automatic pay-off device and method, which can realize automatic pay-off after one drill pipe is pushed in and can keep a guide wire in a tight state during the drilling process, thus improving the pay-off speed and construction efficiency during the guide process.

To fulfil the above objective, in one aspect, the invention provides a wire-guided automatic pay-off device installed on a horizontal directional drilling rig, the horizontal directional drilling rig comprises a carriage assembly, a short joint and a drill pipe, a rear end of the short joint is fixedly connected to a main shaft of the carriage assembly and rotates together with the main shaft, and a front end of the short joint is connected to the drill pipe; the wire-guided automatic pay-off device comprises a conductive ring assembly, a brush assembly, a winding device, a guide device and a guide wire, the conductive ring assembly is fixed to the main shaft of the carriage assembly and rotates together with the main shaft, the brush assembly is fixed to a body of the carriage assembly and does not rotate with the main shaft, and a conductive end of the brush assembly is in contact with the conductive ring assembly; the guide device and the winding device are fixedly connected to the short joint and rotate together with the short joint; the guide wire is wound on the winding device, and has one end connected to the conductive ring assembly and the other end passing through the guide device, then penetrating into a central hole in the drill pipe from a rear end of the drill pipe, and finally extending out from a front end of the drill pipe to be connected to a guide wire in a drill pipe that has been pushed into a working face, thus forming a complete and tight guide wire.

Further, the conductive ring assembly comprises a conductive ring, an insulation ring, fixing nuts and fixing screws, the insulation ring is located on an inner side of the conductive ring, and the conductive ring comprises two semicircular rings which are connected by means of the fixing screws and the fixing nuts.

Further, an end of the guide wire is pressed against joints of the two semicircular rings by means of the fixing nuts and the fixing screws.

Further, the winding device and the guide device are fixedly connected to the short joint by means of hoops.

Further, the winding device comprises a wire reel, two side supports I, a connecting shaft and a hoop I, the wire reel is arranged between the two side supports I and supported by the connecting shaft, and the wire reel is rotatable with respect to the connecting shaft, and the side supports I are fixed to the hoop I.

Further, the guide device comprises two guide wheels and two side supports II, the two guide wheels are installed between the two side supports II, and a gap is formed between the two guide wheels.

In another aspect, the invention discloses a pay-off method for the wire-guided automatic pay-off device, comprising the following steps:

Step 1, pushing, by the carriage assembly, the drill pipe directly connected to the carriage assembly to the front, and then separating the drill pipe from the carriage assembly;

Step 2, allowing the carriage assembly to retreat by a distance greater than a length of one drill pipe, and automatically paying off, by the winding device, the guide wire by a length equal to the distance to keep the guide wire in a tight state; and Step 3, cutting off the guide wire at a rear end of the drill pipe in Step 1, providing a new drill pipe, allowing the guide wire to penetrate into a central hole of the new drill pipe and then extend out from an end of the new drill pipe, connecting a rear end of the new drill pipe to the short joint, connecting the guide wire to the guide wire at the rear end of the drill pipe in Step 1, and then connecting a front end of the new drill pipe to the drill pipe in front.

The invention has the following beneficial effects: by installing the pay-off device on the horizontal directional drilling rig, the guide wire can be kept in a tight state, such that the situation where the guide wire in the drill pipe, that has been pushed into a working face, breaks at a joint due to impact from mud, leading to a drilling failure can be prevented. In addition, the winding device is provided to realize automatic pay-off, thereby improving construction efficiency and reducing the labor cost.

In the FIGS.: 1, conductive ring assembly; 11, conductive ring; 12, insulation ring: 13, fixing nut; 14, fixing screw; 2, brush assembly; 3, winding device; 31, wire reel; 32, side support I; 33, connecting shaft; 34, hoop I; 4, guide device; 41, guide wheel: 42, side support II: 43, hoop II; 5, guide wire; 6, carriage assembly; 7, short joint; 8, drill pipe.

DETAILED DESCRIPTION OF THE INVENTION

The invention is described in further detail below in conjunction with accompanying drawings and specific embodiments.

Figure 1:
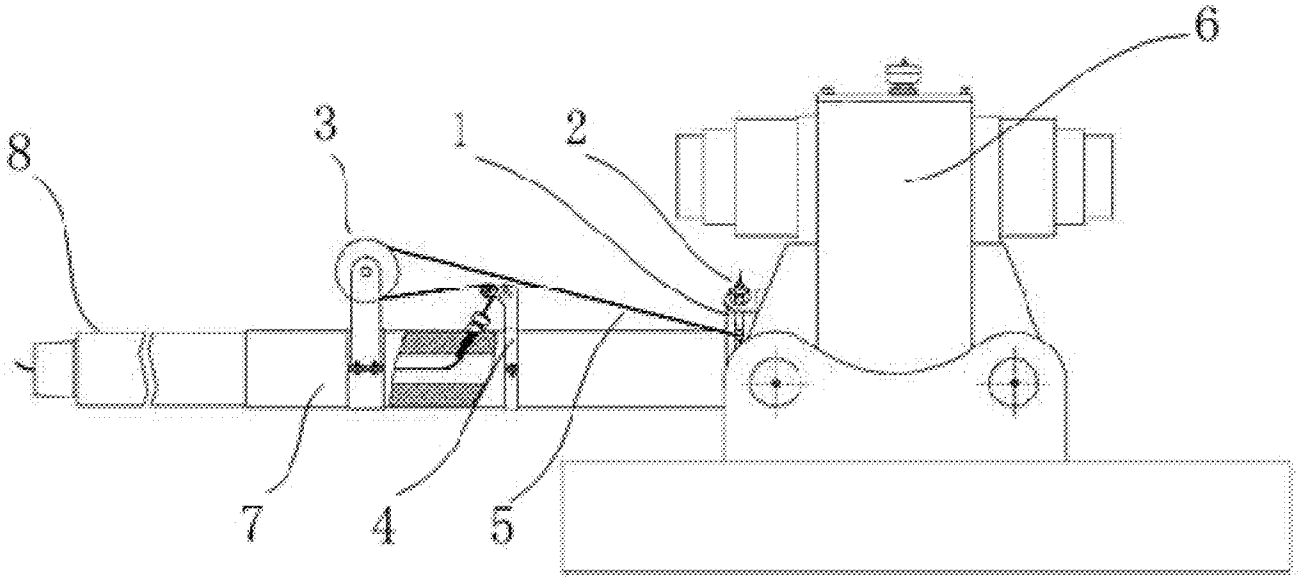
FIG. 1 is a schematic structural view according to the invention.
Figure 8:
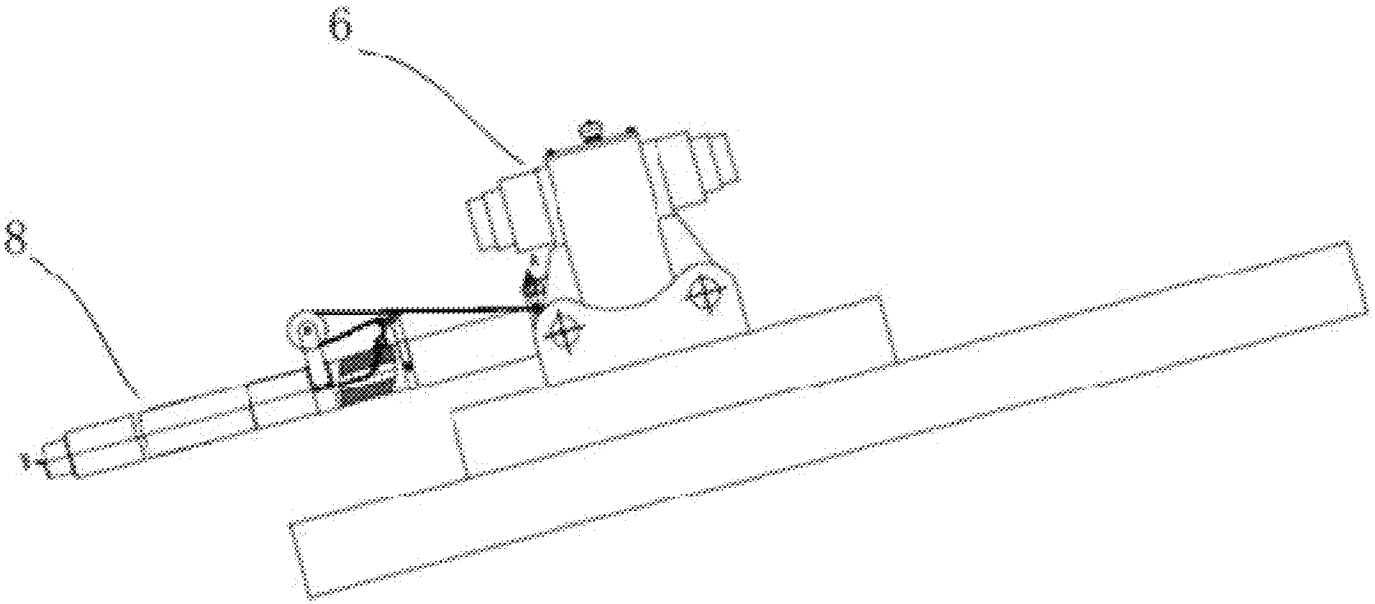
FIG. 8 illustrates a forward pushing process of a carriage assembly.
Figure 9:
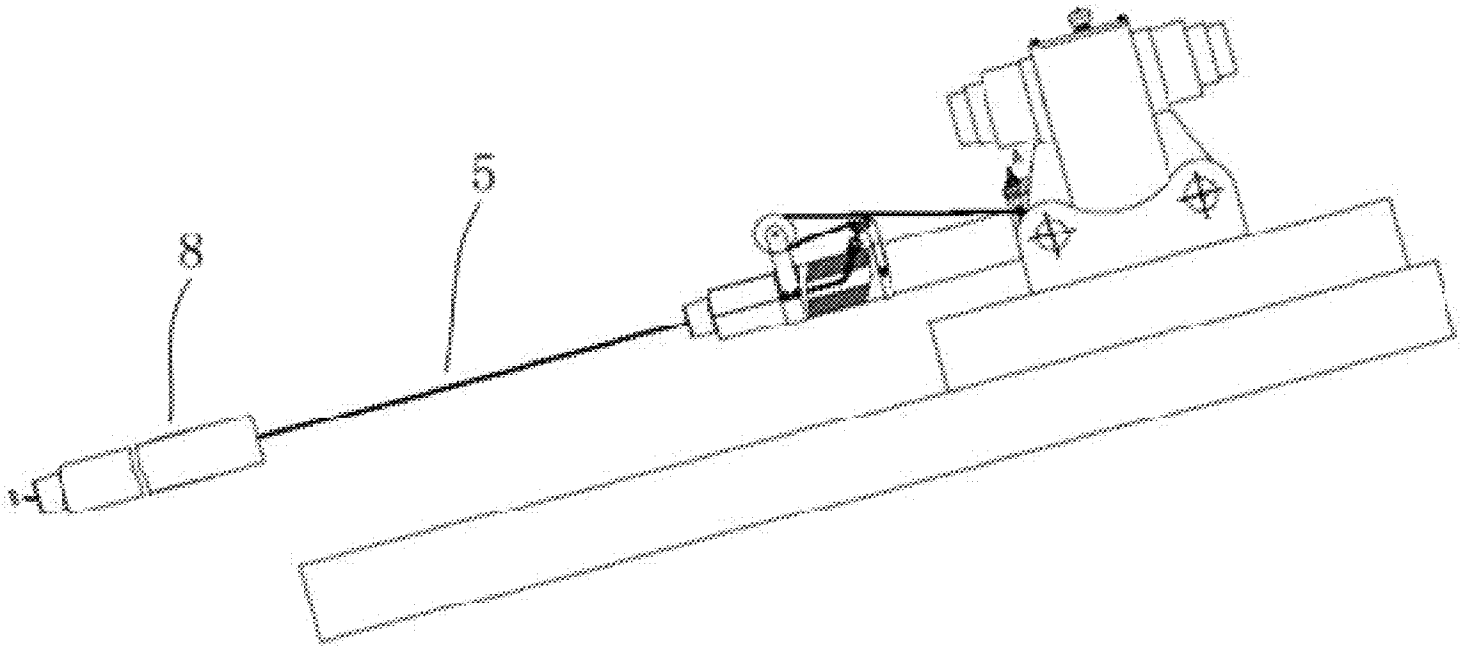
FIG. 9 illustrates a retreating process of the carriage assembly.
Figure 10:
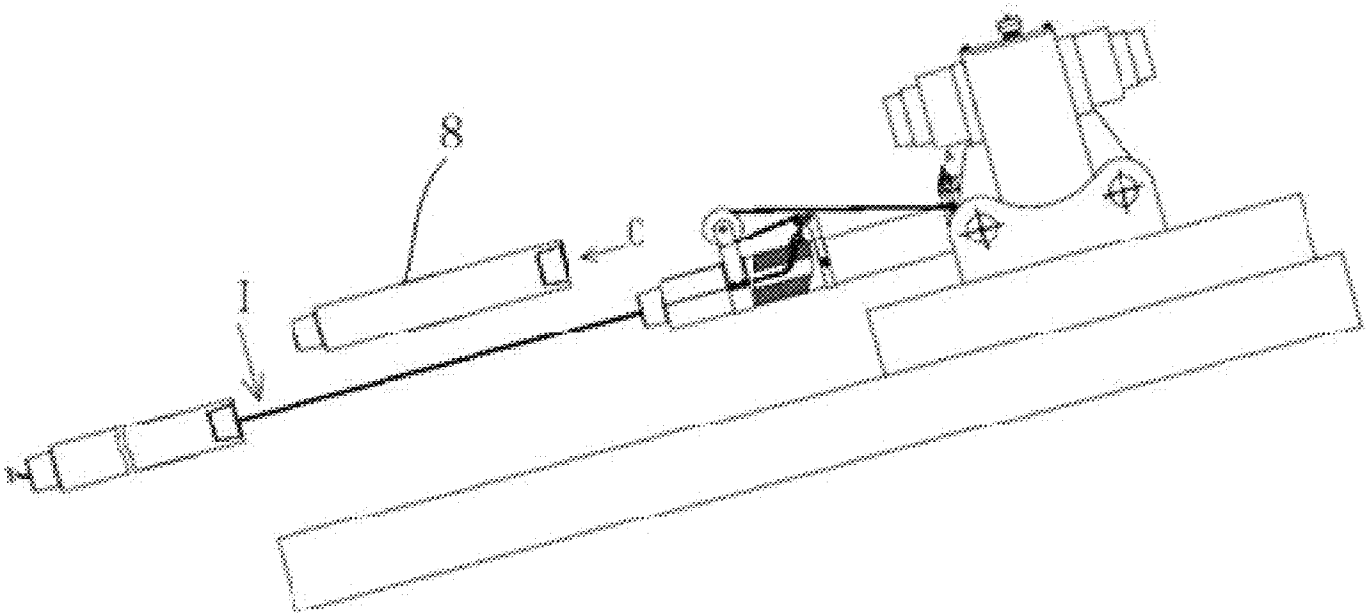
FIG. 10 illustrates a process that a wire passes through a drill pipe.

As shown in FIG. 1, a wire-guided automatic pay-off device is installed on a horizontal directional drilling rig. The horizontal directional drilling rig comprises a carriage assembly 6, a short joint 7 and a drill pipe 8, a rear end of the short joint 7 is fixedly connected to a main shaft of the carriage assembly 6 and rotates together with the main shaft, and a front end of the short joint 7 is connected to the drill pipe 8. The wire-guided automatic pay-off device comprises a conductive ring assembly 1, a brush assembly 2, a winding device 3, a guide device 4, and a guide wire 5, wherein the conductive ring assembly 1 is fixed to the main shaft of the carriage assembly 6 and rotates together with the main shaft, the brush assembly 2 is fixed to a body of the carriage assembly 6 and does not rotate with the main shaft, a conductive end of the brush assembly 2 is in contact with the conductive ring assembly 1, and a wire end of the brush assembly 2 is connected to a control transmission end. The guide device 4 and the winding device 3 are fixedly connected to the short joint 7 and rotate together with the short joint 7. The guide wire 5 is wound on the winding device 3, and has one end connected to the conductive ring assembly 1 and the other end passing through the guide device 4, then penetrating into a central hole in the drill pipe 8 from a rear end of the drill pipe 8, and finally extending out from a front end of the drill pipe 8 to be connected to the guide wire in a drill pipe that has been pushed into a working face, thus forming a complete and tight guide wire. When the horizontal directional drilling rig drills a pilot hole, multiple drill pipes need to be driven underground, and a probe is installed on a drill bit at the front of the drilling rig and communicates with the ground by means of a cable (the guide wire 5). Every time one drill pipe is obliquely pushed into the ground, the guide wire needs to be cut off, then penetrates into a new drill pipe and is then connected to the guide wire in the drill pipe that has been pushed into the ground, as shown in FIG. 8-FIG. 10. According to a traditional operation method, two operators need to perform operations at both ends of a new drill pipe, and the guide wire is paid off manually, so the guide wire (overground and underground) is always in a loose state in operation; because mud may flow back into the central hole in the drill pipe and impact the guide wire and the guidewire in the drill pipe underground has multiple joints, the guide wire in the loose state may break at the joints, leading to communication interruption and re-drilling. By adopting the wire-guided automatic pay-off device, the guide wire (overground and underground) is kept in a tight state to reduce an impact force from mud, such that the guide wire can be prevented from breaking at joints. In addition, when the wire-guided automatic pay-off device is used for paying off the guide wire, only one operator is needed to cut off and connect the guide wire, and the guide wire is paid off automatically, thus improving pay-off efficiency.

Figure 2:
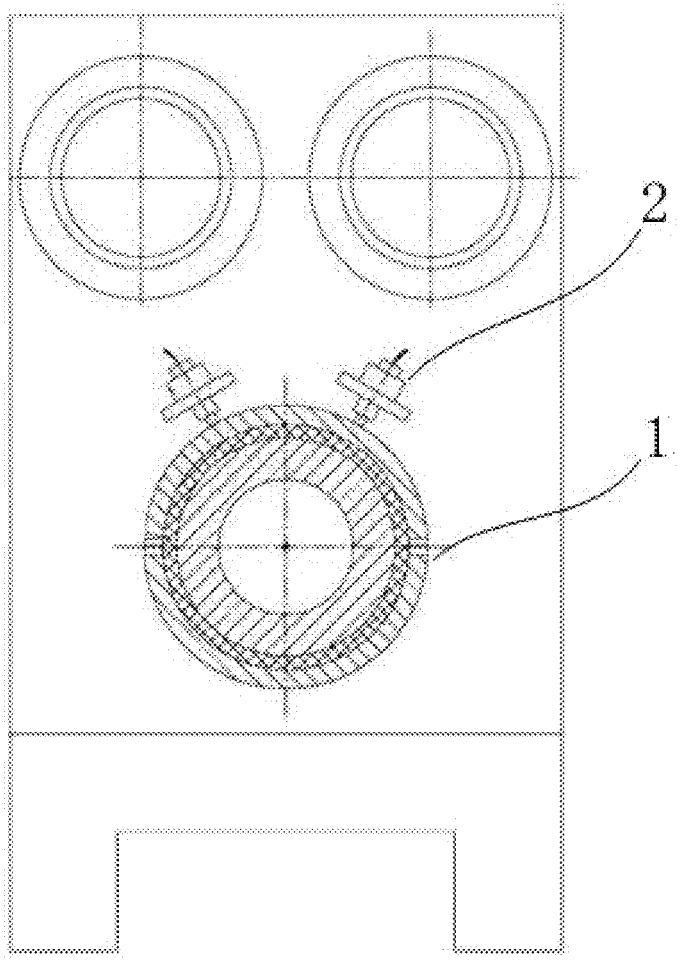
FIG. 2 is a structural view of a conductive ring assembly and a brush assembly.
Figure 3:
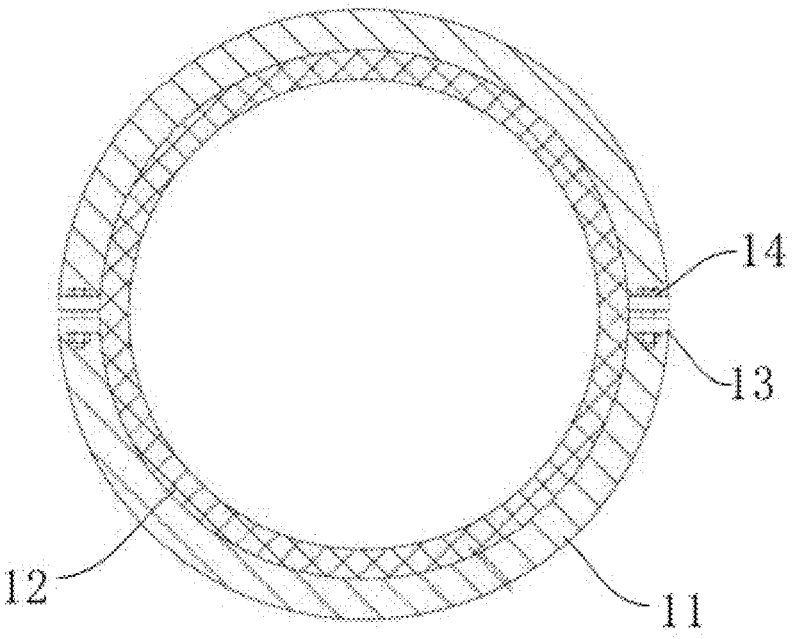
FIG. 3 is a structural view of a conductive ring.

As shown in FIG. 2-FIG. 3, the conductive ring assembly 1 comprises a conductive ring 11, an insulation ring 12, fixing nuts 13 and fixing screws 14, wherein the insulation ring 12 is located on an inner side of the conductive ring 11, and the conductive ring 11 comprises two semicircular rings which are connected by means of the fixing nuts 13 and the fixing screws 14. One end of the guide wire 5 is pressed against joints of the two semicircular rings by means of the fixing nuts 13 and the fixing screws 14.

The winding device 3 and the guide device 4 are fixedly connected to the short joint 7 by means of hoops, or the winding device 3 and the guide device 4 are fixed to the short joint 7 by welding. The hoop is formed by two connected semicircular rings or is formed by a circular ring. In this embodiment, the hoop is formed by two connected semicircular rings.

Figure 4:
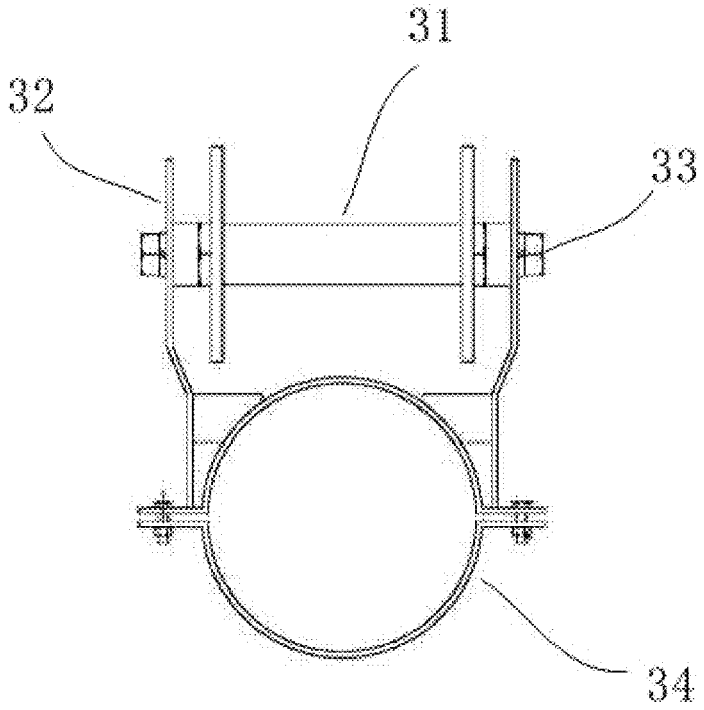
FIG. 4 is a front view of a winding device.
Figure 5:
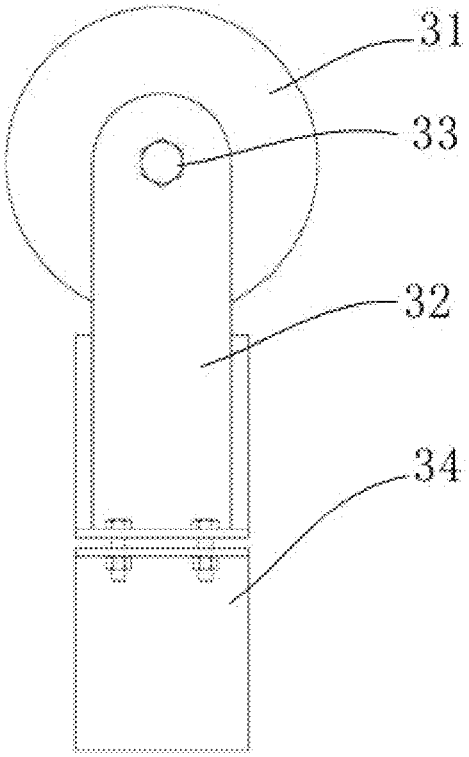
FIG. 5 is a side view of the winding device.

As shown in FIG. 4-FIG. 5, the winding device 3 comprises a wire reel 31, two side supports I 32, a connecting shaft 33 and a hoop I 34, wherein the wire reel 31 is arranged between the two side supports I 32 and supported by the connecting shaft 33, the wire reel 31 is rotatable with respect to the connecting shaft 33 by means of a bearing installed on the connecting shaft, and the side supports I 32 are fixedly welded on the hoop I 34.

Figure 6:
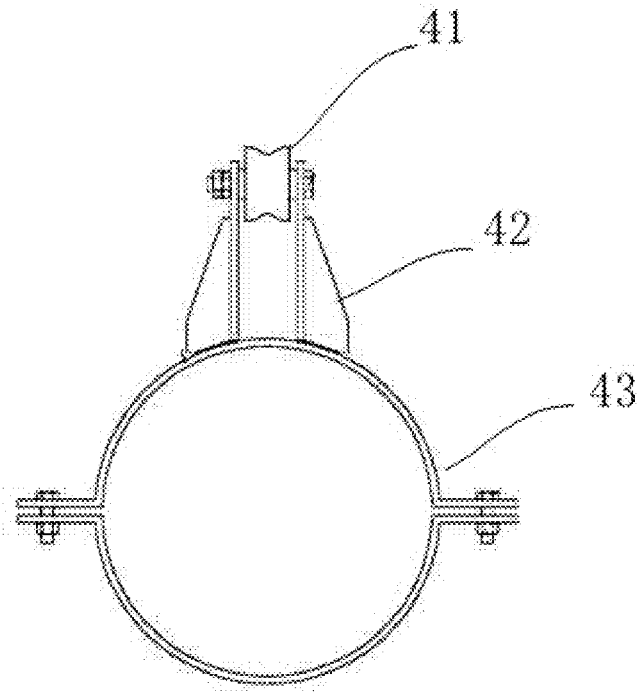
FIG. 6 is a front view of a guide device.
Figure 7:
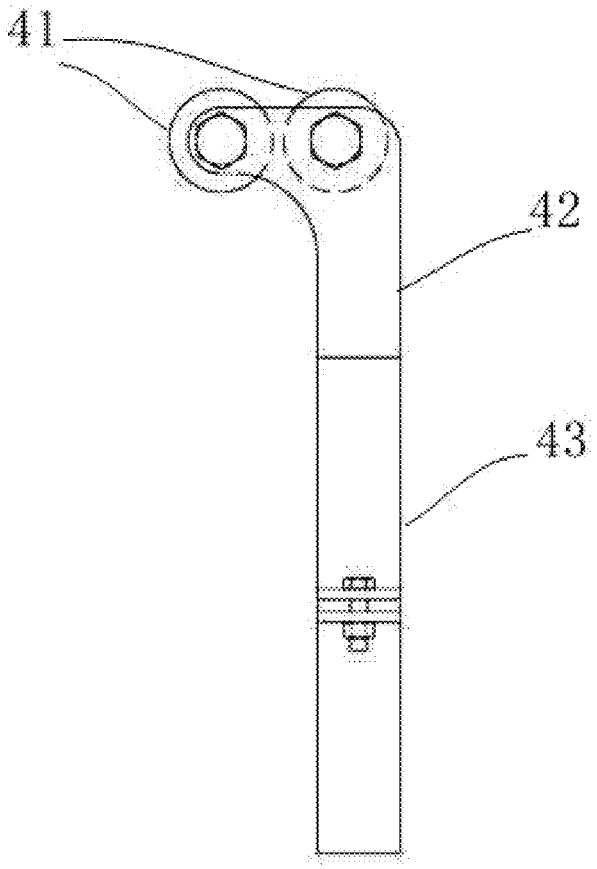
FIG. 7 is a side view of the guide device.

As shown in FIG. 6-FIG. 7, the guide device 4 comprises two guide wheels 41 and two side supports II 42, wherein the two guide wheels 41 are installed between the two side supports II 42, and a gap is formed between the two guide wheels 41. The two guide wheels 42 are rotatable. The guide wire 5 passes through the gap between the two guide wheels 41.

As shown in FIG. 8-FIG. 10, the invention further provides a pay-off method for the wire-guided automatic pay-off device, comprising the following steps:

Step 1, the carriage assembly 6 pushes the drill pipe 8 directly connected thereto to the front, and then the drill pipe 8 is separated from the carriage assembly 6;

Step 2, the carriage assembly 6 retreats by a distance greater than the length of one drill pipe, and the winding device 3 automatically pays off the guide wire 5 by a length equal to the distance to keep the guide wire 5 in a tight state; and Step 3, the guide wire 5 is cut off at a rear end of the drill pipe in Step 1, a new drill pipe 8 is provided, the guide wire 5 penetrates into a central hole of the new drill pipe 8 and then extends out from an end of the new drill pipe 8, a rear end of the new drill pipe 8 is connected to the short joint 7, the guide wire 5 is connected to the guide wire at the rear end of the drill pipe in Step 1, and then a front end of the new drill pipe 8 is connected to the drill pipe in front.

The pay-off method can reduce the labor cost and realize automatic pay-off, and can still keep the whole guide wire (overground and underground) in a tight state after the new drill pipe is added.

The embodiments of the invention are described in detail above in conjunction with the accompanying drawings, but the invention is not limited to the above embodiments. Various modifications can be made by those skilled in the art within their knowledge scope without departing from the concept of the invention, and all these modifications should also fall within the protection scope of the claims of the invention.

What is claimed is:

1. A wire-guided automatic pay-off device, being installed on a horizontal directional drilling rig, the horizontal directional drilling rig comprising a carriage assembly, a short joint and a drill pipe, a rear end of the short joint being fixedly connected to a main shaft of the carriage assembly and rotating together with the main shaft, and a front end of the short joint being connected to the drill pipe, wherein the wire-guided automatic pay-off device comprises a conductive ring assembly, a brush assembly, a winding device, a guide device and a guide wire, the conductive ring assembly is fixed to the main shaft of the carriage assembly and rotates together with the main shaft, the brush assembly is fixed to a body of the carriage assembly and does not rotate with the main shaft, and a conductive end of the brush assembly is in contact with the conductive ring assembly; the guide device and the winding device are fixedly connected to the short joint and rotate together with the short joint; the guide wire is wound on the winding device, and has one end connected to the conductive ring assembly and the other end passing through the guide device, then penetrating into a central hole in the drill pipe from a rear end of the drill pipe, and finally extending out from a front end of the drill pipe to be connected to a guide wire in a drill pipe that has been pushed into a working face, thus forming a complete and tight guide wire, wherein the winding device and the guide device are fixedly connected to the short joint by means of hoops.

2. The wire-guided automatic pay-off device according to claim 1, wherein the conductive ring assembly comprises a conductive ring, an insulation ring, fixing nuts and fixing screws, the insulation ring is located on an inner side of the conductive ring, and the conductive ring comprises two semicircular rings which are connected by means of the fixing nuts and the fixing screws.

3. The wire-guided automatic pay-off device according to claim 2, wherein an end of the guide wire is pressed against joints of the two semicircular rings by means of the fixing nuts and the fixing screws.

4. The wire-guided automatic pay-off device according to claim 1, wherein the winding device comprises a wire reel, two side supports I, a connecting shaft and a hoop I, the wire reel is arranged between the two side supports I and supported by the connecting shaft, and the wire reel is rotatable with respect to the connecting shaft, and the side supports I are fixed to the hoop I.

5. The wire-guided automatic pay-off device according to claim 1, wherein the guide device comprises two guide wheels and two side supports II, the two guide wheels are installed between the two side supports II, and a gap is formed between the two guide wheels.

6. A pay-off method for the wire-guided automatic pay-off device according to claim 1, comprising the following steps:

Step 1, pushing, by the carriage assembly, the drill pipe directly connected to the carriage assembly to the front, and then separating the drill pipe from the carriage assembly;

Step 2, allowing the carriage assembly to retreat by a distance greater than a length of one drill pipe, and automatically paying off, by the winding device, the guide wire by a length equal to the distance to keep the guide wire in a tight state; and Step 3, cutting off the guide wire at a rear end of the drill pipe in Step 1, providing a new drill pipe, allowing the guide wire to penetrate into a central hole of the new drill pipe and then extend out from an end of the new drill pipe, connecting a rear end of the new drill pipe to the short joint, connecting the guide wire to the guide wire at the rear end of the drill pipe in Step 1, and then connecting a front end of the new drill pipe to the drill pipe in front.

* * * * *